United States Patent [19]

Cocco

[11] 4,435,062

[45] Mar. 6, 1984

[54] FILM PROCESSING APPARATUS

[75] Inventor: Vincent L. Cocco, Wakefield, Mass.

[73] Assignee: Polaroid Corporation, Cambridge, Mass.

[21] Appl. No.: 453,801

[22] Filed: Dec. 27, 1982

[51] Int. Cl.[3] ..... G03D 5/06

[52] U.S. Cl. ..... 354/303; 354/88; 354/318

[58] Field of Search ..... 354/83, 84, 85, 86, 354/87, 88, 301, 303, 304, 318

[56] References Cited

U.S. PATENT DOCUMENTS

| | | | |
|---|---|---|---|
| 2,558,857 | 7/1951 | Land . | |
| 3,069,266 | 12/1962 | Land . | |
| 3,179,517 | 4/1965 | Tregillus et al. . | |
| 3,314,792 | 4/1967 | Land . | |
| 3,345,165 | 10/1967 | Land . | |
| 3,498,203 | 3/1970 | Land . | |
| 3,907,563 | 9/1975 | Land . | |
| 4,309,100 | 1/1982 | Bendoni et al. | 354/318 |
| 4,310,620 | 1/1982 | Meyer . | |
| 4,370,045 | 1/1983 | Holmes | 354/318 |
| 4,401,381 | 8/1983 | Cocco | 354/303 |

*Primary Examiner*—A. A. Mathews

*Attorney, Agent, or Firm*—John S. Vale

[57] ABSTRACT

A film processing apparatus is provided for wetting an outer surface of a film unit with a low viscosity processing liquid supplied from a liquid applicator pad enclosed in a pouch-like container forming part of a multi-container liquid applicator packaging web. The apparatus is configured to manipulate the web so as to open each of the containers in sequence and present the applicator pad therein at a film processing position.

18 Claims, 6 Drawing Figures

FILM PROCESSING APPARATUS

BACKGROUND OF THE INVENTION

The present invention relates to the field of photography and, more specifically, to film processing apparatus for applying a low viscosity processing liquid to an outer surface of an exposed sheet-like photosensitive film unit to initiate processing thereof.

It is recognized that substantial cost reductions may be realized in self-developing or self-processing film systems if the film unit can be treated with a low viscosity (having a consistency similar to water) processing liquid rather than the jelly-like higher viscosity liquid employed in most commercially available systems. This is because higher viscosity liquids require the use of mechanically complex and relatively expensive spread control structures in the film unit, cassette and camera (e.g. precision rollers) to achieve uniform fluid distribution over a given surface of the exposed film unit. On the other hand, low viscosity liquids tend to be more self-spreading and uniform distribution may be readily achieved without having to resort to elaborate and costly spread control systems.

Representative examples of self-developing film systems wherein the outer surface of an exposed photosensitive sheet is wetted with a low viscosity liquid to initiate processing may be found in U.S. Pat. No. 3,179,517 and commonly assigned U.S. Pat. Nos. 3,314,792; 3,345,165 and 3,907,563 wherein a processing web roll that is pre-soaked with a low viscosity liquid, or is wetted just prior to processing, is brought into face-to-face contact with an exposed photosensitive sheet to wet its outer surface and initiate the development process. Also, see commonly assigned U.S. Pat. Nos. 3,069,266 and 3,498,203 for examples of structures wherein a low viscosity processing liquid is delivered to the exposed film surface by means of various capillary action applicators.

One problem with these systems is that if the entire web is not used within a very short time after its container is opened, it is very difficult to protect the unused portion of the web from being contacted by the atmosphere which will cause the liquid to evaporate or combine with atmospheric oxygen and carbon dioxide which tends to diminish the chemical effectiveness of the processing liquid. Also, residual liquid on the capillary action applicators tends to dry out and crust over thereby blocking liquid transport passageways therein.

U.S. Pat. No. 4,310,620 discloses a low viscosity processing liquid applicator in the form of an absorbent spreading sheet or pad that is soaked with a low viscosity processing liquid and is laminated on both sides with a foil which is impervious to water. The foil sheets form an enclosure to protect the wet pad against evaporation and contamination. Just before use, one of the foil sheets is stripped off to expose the impregnated spreading sheet which is then brought into contact with the film unit surface. However, there is no teaching or even suggestion of an apparatus that is configured to easily manipulate such applicators and conveniently store the surplus material after use for disposal.

Commonly assigned and co-pending applications, U.S. Ser. Nos. 436,189 and 436,078 (now U.S. Pat. No. 4,401,381) filed on Oct. 22, 1982, and U.S. Ser. Nos. 445,416 and 445,417, filed on Nov. 30, 1982, are directed to individual selfprocessing film units, each having a low viscosity liquid applicator attached to one end thereof and to processing apparatus for manipulating such applicators.

For some commercial and industrial applications it may be more convenient and economical to provide the applicators separate from the film units. For example, the applicators could be provided on a separate multi-container liquid applicator packaging web comprising an elongated carrier sheet, a plurality of processing liquid soaked pads attached to one side of the carrier sheet in spaced apart relation along its length, and an elongated flexible cover sheet overlying the carrier sheet in covering relation to the applicator pads. The carrier and cover sheets may be releasably sealed together in facing areas thereof surrounding each of the applicator pads to form a plurality of serially connected pouch-like containers on the web, each enclosing a corresponding one of the applicator pads therein.

What is needed is a processing apparatus for manipulating such an applicator packaging web so as to sequentially uncover the wet applicator pads as needed by stripping away the cover sheet therefrom, presenting an uncovered applicator pad at a processing position, and storing surplus material, including the expended applicator pads, for subsequent disposal.

Commonly assigned U.S. Pat. No. 2,558,857 discloses a photographic developer element comprising a water and vapor impervious sheet that is coated with a very high viscosity processing liquid layer. When rolled into a coil, the impervious sheet protects the next length of liquid coating. However, there is no cover sheet per se that has to be removed to provide access to the processing liquid layer.

Therefore, it is an object of the present invention to provide a film processing apparatus that is configured for use with such a multi-container liquid applicator packaging web employing releasably sealed carrier and cover sheets.

It is another object to provide such a film processing apparatus that is capable of advancing the web in such a manner so as to strip the cover sheet from the carrier sheet to provide successive access to applicator pads thereon.

Yet another object is to provide such a film processing apparatus that stores the expended web components for subsequent disposal.

Another object is to provide such a film processing apparatus that is easy to use.

Other objects of the invention will, in part, be obvious and will, in part, appear hereinafter.

SUMMARY OF THE INVENTION

The present invention provides a processing apparatus for use with a liquid applicator packaging web. The web is of the type including an elongated flexible carrier sheet, a plurality of liquid applicator pads secured to one side of the carrier sheet in spaced apart relation along its length, each of the applicators yieldably holding a supply of a low viscosity processing liquid adapted to be applied to an outer surface of a sheet-like photosensitive film unit to initiate processing thereof, and an elongated flexible cover sheet overlying the carrier sheet in covering relation to the applicator pads, the carrier and cover sheets being releasably sealed together in facing areas thereof surrounding each of the applicator pads to form a plurality of serially connected containers on the web, each enclosing a corresponding one of the applicator pads therein.

Broadly speaking, the apparatus includes means for supporting such a film unit; means for supporting such a liquid applicator packaging web; means for incremently advancing the web relative to the web support means for separating the cover sheet from the carrier sheet to successively open each of the containers and locate the corresponding uncovered applicator pad therein at a processing position; and means for bringing the uncovered pad at the processing position into liquid-contact with an outer surface of the film unit to initiate processing thereof.

The packaging web supporting means preferably includes a first storage section for storing that portion of the web having the releasably sealed containers thereon, a processing section where an uncovered applicator pad supported on the carrier sheet is adapted to be located in preparation for bringing the pad into liquid-yielding contact with the outer surface of a film unit supported by the film supporting means, and a second storage section for storing that portion of the carrier sheet having expended applicator pads thereon.

The web advancing means preferably include means for independently advancing the web carrier and cover sheets incremently relative to the web support means so that a portion of the cover sheet is separated from the carrier sheet to open a container, and that portion of the carrier sheet having an uncovered applicator pad thereon is advanced from the first storage section to the processing section and, following processing operations, is advanced to the second storage section.

BRIEF DESCRIPTION OF THE DRAWINGS

For a fuller understanding of the nature and objects of the present invention, reference may be had to the following detailed description taken in connection with the accompanying drawings wherein.

DESCRIPTION OF THE PREFERRED EMBODIMENT

Figure 1:
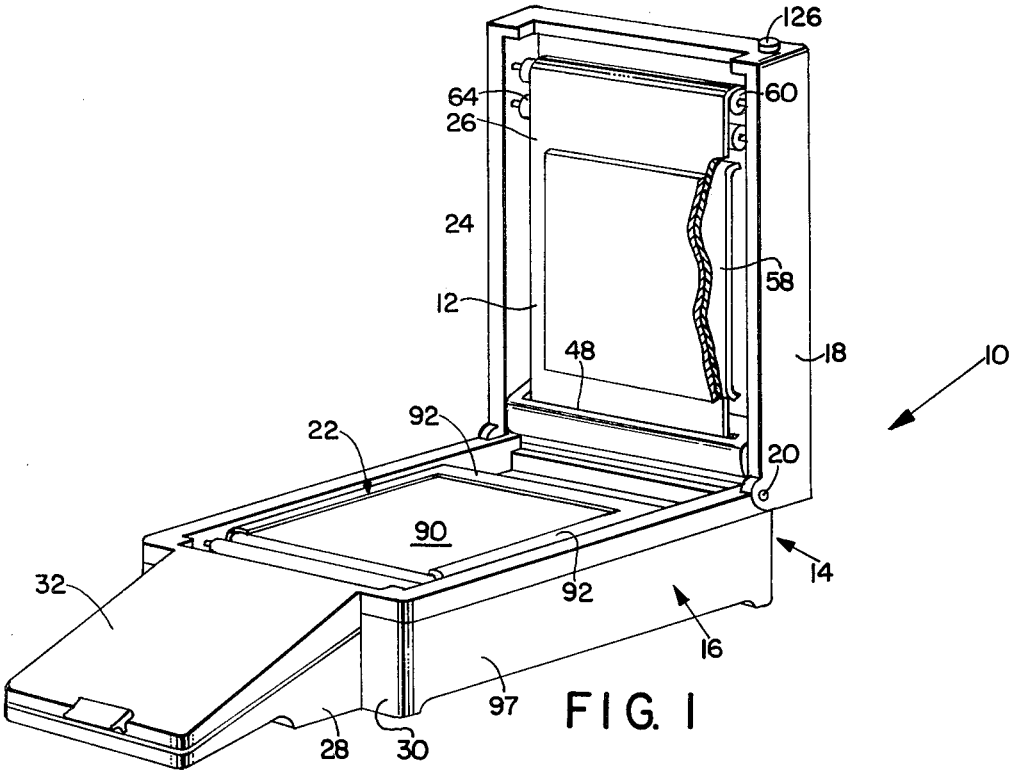
FIG. 1 is a perspective view of a film processing apparatus embodying the present invention shown with its cover section in a raised position.
Figure 2:
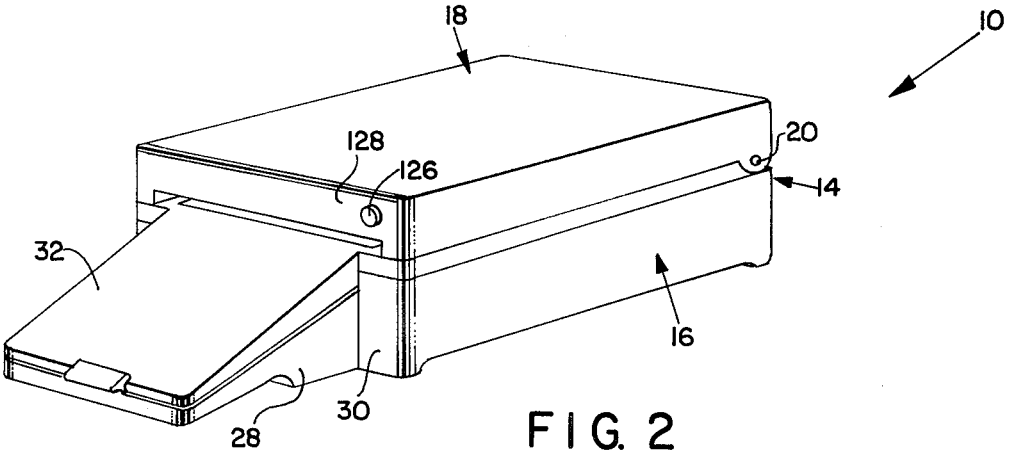
FIG. 2 is a perspective view of the processing apparatus of FIG. 1 showing the cover section in its closed position.

With reference to FIGS. 1 and 2, the present invention provides a novel film processing apparatus 10 configured for use with a later-to-be-described processing liquid applicator packing web 12.

Apparatus 10 includes a box-like housing 14 having a bottom or base housing section 16 and a top or cover housing section 18 pivotally coupled to base section 16 their respective trailing ends, as suggested at pivot pin at 20, For movement between an open or raised position as shown in FIG. 1 and the closed position shown in FIG. 2 where cover section 18 rests on top of base section 16 in overlying covering relation thereto.

Apparatus 10 is adapted to be used in a darkroom, or other actinic light-excluding environment, for processing a previously exposed sheet-like photosensitive film unit which may be of the conventional type providing a negative image as a result of development or the self-developing type wherein a visible positive image is produced as result of a development and diffusion-transfer process.

As best shown in FIG. 1, the base section 16 includes therein means, such as a horizontally disposed movable platen 22, for supporting such an exposed film unit in a position to be processed by having an outer surface thereof wetted with a low viscosity (having a consistency similar to water) processing liquid.

The cover section 18 has later-to-be-described structure therein for supporting the liquid applicator packaging web 12 and later-described means for manipulating the packaging web to present a processing liquid-soaked applicator pad 24 on the underside of a web carrier sheet 26 at a processing position so that when the cover section 18 is closed the pad 24 is brought into overlying relation to a film unit supported on platen 22.

Optionally, apparatus 10 may include a film receiving chamber assembly 28 shown attached to a leading end wall 30 of base section 16 for receiving a film unit therein after it has been treated with the liquid from pad 24. Access to the interior of chamber assembly 28 for removing a film unit is provided by a pivoting top cover 32 mounted on assembly 28.

Figure 3:
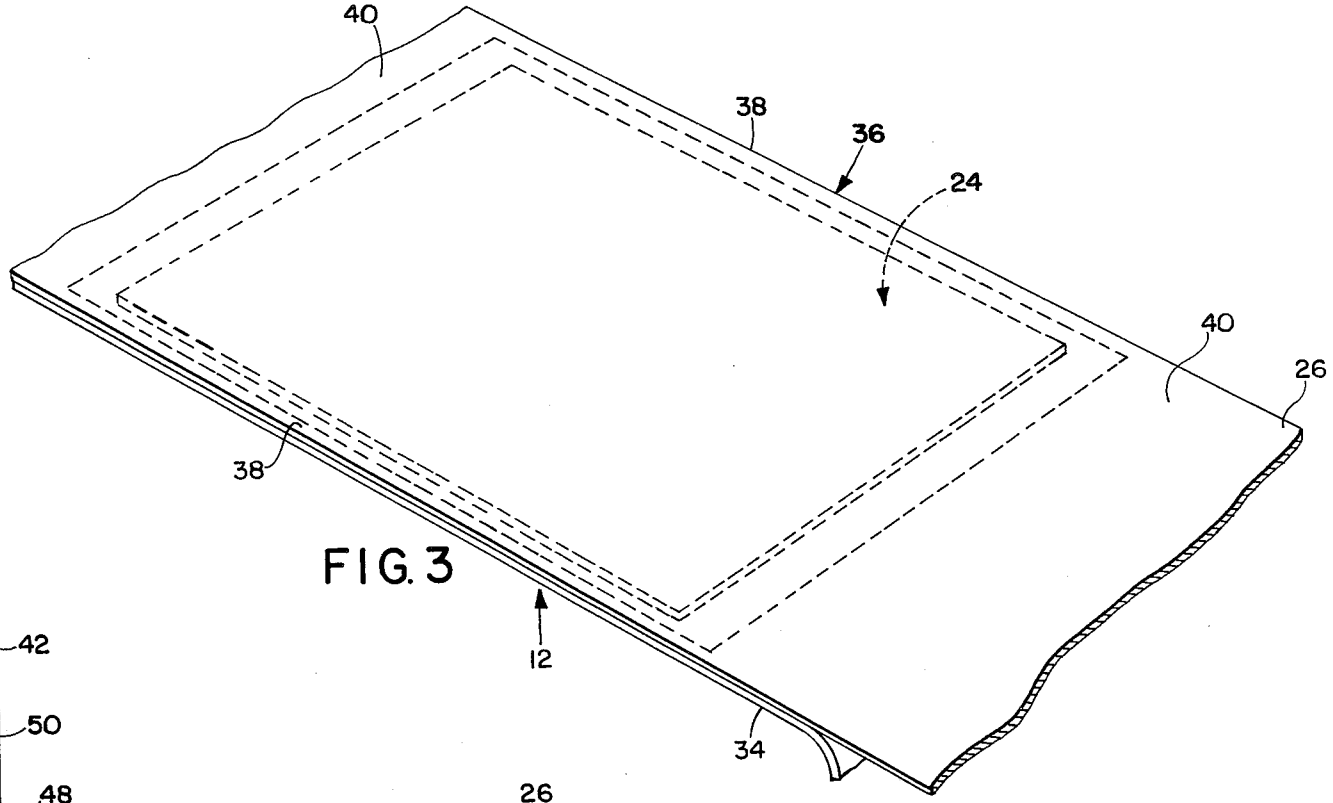
FIG. 3 is a perspective view of a portion of a multi-container liquid applicator packaging web for use with the processing apparatus.
Figure 4:
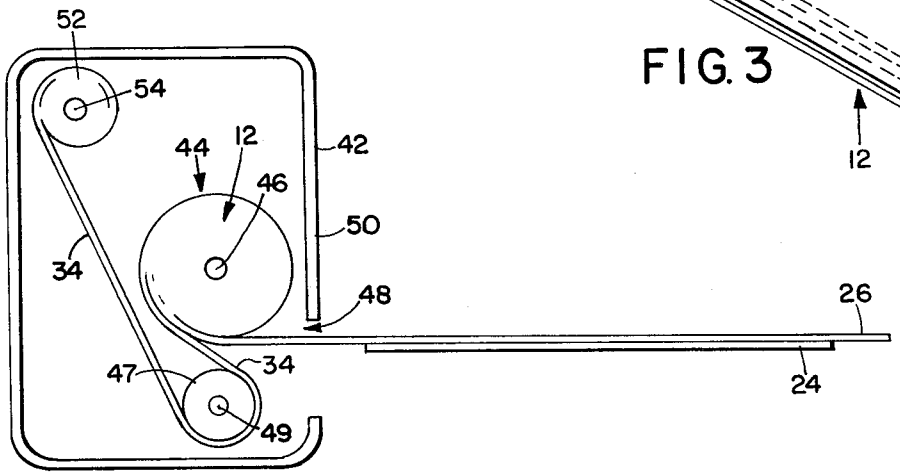
FIG. 4 a side cross-sectional view of a container for holding a length of packaging web in coiled form therein.

As best shown in FIGS. 3 and 4, the liquid applicator packing web 12 comprises an elongated flexible carrier sheet 26, a plurality of liquid applicator pads 24 (only one shown) secured to the underside of carrier sheet 26 in predetermined spaced-apart relation along its length, each of the applicator pads 24 yieldably holding a supply of a low viscosity processing liquid adapted to be applied to an outer surface of a sheet-like photosensitive film unit to initiate processing thereof, and an elongated flexible cover sheet 34 overlying (or as viewed in FIGS. 3 and 4 underlying) the carrier sheet 26 in covering relation to the applicator pads 24. The carrier and cover sheets 26 and 34 are releasably sealed together in facing areas thereof surrounding each of the applicator pads 24 to form a plurality of serially connected pouch-like containers 36 on the web 12, each container 36 enclosing a corresponding one of the applicator pads 24 therein.

In a preferred embodiment, the carrier and cover sheets are formed of a liquid and air impervious material which may be easily selectively sealed together. When the container 36 is sealed as shown in FIG. 3, it forms a vapor and liquid impervious enclosure about the wet applicator pad 24 therein which prevents evaporation of the processing liquid and also protects the liquid from contamination by atmospheric oxygen and carbon dioxide. The seal between the cover and carrier sheets also preferably is releasable so that the cover sheet 34 may be stripped away from the carrier sheet 26 to uncover and provide access to the applicator pad thereon for processing a film unit.

One suitable type of material that may be used to form both the carrier sheet 26 and the cover sheet 34 is a laminate or composite material comprising a metalic foil having a thermoplastic layer coated on one side thereof. The foil acts as a liquid and vapor barrier while the thermoplastic provides resistance against tearing and also serves as a bonding or sealing medium.

The applicator pad 24 may be formed of any suitable thin, flexible, absorbent material that will not deteriorate or react in the presence of photographic processing liquids. Pad 24 may be formed of a sponge-like plastic foam, a woven or non-woven textile or any number of other absorbent materials. One material that has been found to perform in a satisfactory manner is a polypropylene non-woven sheet material marketed under the trade name, Webril, by the Kendall Corporation.

The pad 24 may be attached to the thermoplastic coated side of the carrier sheet 26 by any suitable means such as thermocompression bonding or adhesive bonding. After pad 24 has been wet with the liquid processing reagent, the cover sheet 34 is brought into superposition with the carrier sheet 26 with their respective thermoplastic coated sides in facing relation. The facing lateral opposite edge portions 38 of the carrier and cover sheets outboard of the applicator pads 24 are sealed together along the entire length of the web 12. Transverse seals 40 extending across the width of the web between the edge seals 38 are made between adjacent pads 24 on carrier sheet 26 thereby forming the individual pouch-like compartments 36 for enclosing each of the pads 24.

Those skilled in the art will appreciate that the edge seals 38 and the transverse seals 40 between adjacent pads may be made by methods other than thermobonding. For example, these strippable seals may be made by adhesive bonding.

In the illustrated embodiment, apparatus 10 is configured for use with a disposable packaging web assembly comprising a web container 42 having a coiled length or supply roll 44 of the packaging web 12 therein mounted for rotation about a supply roll shaft 46.

Container 42 is preferably a molded plastic, elongated, box-like structure having an exit opening 48 in the lower portion of its forward wall 50.

The supply roll 44 is mounted on shaft 46 so it is situated just behind forward wall 50 and above exit slot 48. The supply roll 44 is formed of a predetermined length of packaging web 12 so as to have a predetermined number (e.g. 10) of serially connected pouch-like containers 36 thereon.

As best shown in FIGS. 1 and 4, the web 12 is adapted to be advanced from the supply roll 44 so that the carrier sheet 26 having the applicator pads 24 secured thereto exits from housing 42 through opening 48 while the cover sheet 34 is advanced along a divergent path of travel within container 42 so that it is strippably peeled or separated from the carrier sheet 26, to unseal and open a container 36 as it emerges from the bottom of supply roll 44 to uncover the liquid-soaked pad 24 therein. While the carrier sheet 26 follows a horizontal exit path of travel through opening 48, the cover sheet 34 is guided along a downwardly directed divergent path of travel within the confines of container 42 defined by a guide roller 47 rotatably mounted on shaft 49 and around which cover sheet 34 passes, and a cover sheet take-up reel 52 rotatably mounted on a shaft 54 in the upper rear corner of housing 42 to which cover sheet 34 is attached. As will become apparent later, take-up reel 52 is rotatably driven to wind the cover sheet 34 thereon and serves both as means for advancing the cover sheet 34 and means for storing it after it has been stripped away from carrier sheet 26 for subsequent disposal.

Figure 5:
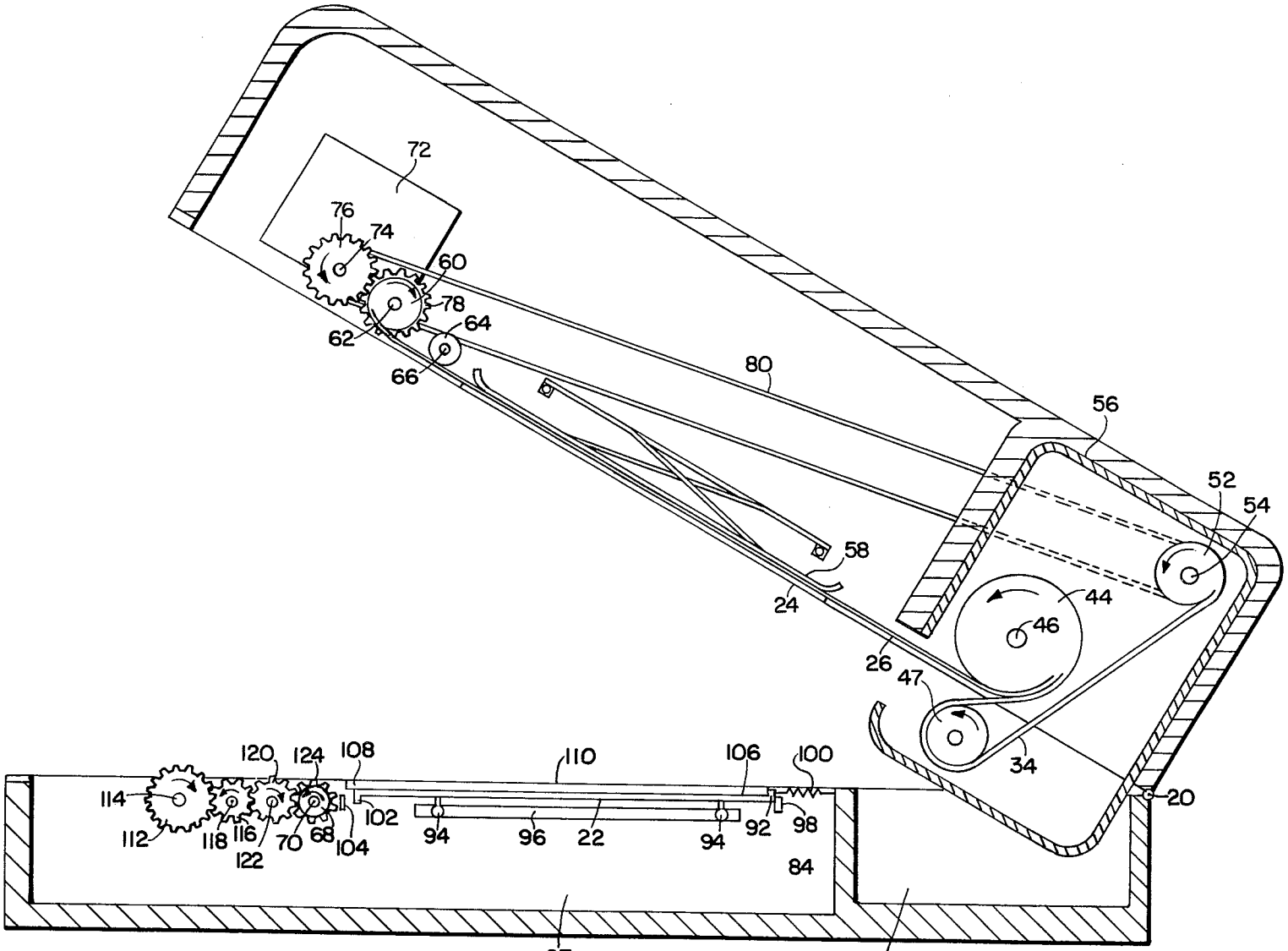
FIG. 5 is a longitudinal cross-sectional view of the film processing apparatus shown with the cover section in a raised position.

As best shown in FIGS. 1, 4 and 5 the cover section 18 has a first storage section 56 in the form of a chamber or recess at the trailing end of cover section 18 for replaceably receiving a container 42 having a supply roll 44 of web 12 therein. Thus, the web supporting means on cover section 18 includes a first storage section for storing that portion of the web having the releasably sealed containers 36 thereon.

When container 42 is located at its operative position in recess 56, the exit opening or slot 48 faces the forward end of the cover section. The carrier sheet 26 extends through the exit slot 48, across a spring-loaded platen 58 mounted on a central portion of cover section 18 and is attached to a carrier sheet take-up reel 60 mounted near the leading end of cover section 18.

The spring platen 58 defines a processing section wherein an uncovered applicator pad 24 supported on the carrier sheet 26 is adapted to be located in preparation to bringing the pad into liquid-yielding contact with the outer surface of a film unit supported on the film unit support platen 22 in base section 16.

The rotatably mounted carrier sheet take-up reel 60 serves as both means for advancing the carrier sheet along a predetermined path within apparatus 10 and, as the carrier sheet progresses from the processing station and is wound thereon, serves as means for storing that portion of the carrier sheet having expended applicator pads 24 thereon.

Thus, the area at the forward end of cover section 18 where carrier sheet take-up reel 60 is rotatably mounted on take-up reel shaft 62 serves as a second storage section for storing that portion of the carrier sheet having expended applicator pads thereon. The take-up reel 60 may be permanently mounted in the cover section 18 and have means thereon for attaching a carrier sheet leader that extends out of container opening 48. Alternatively, the carrier sheet take-up reel 60 may be a disposable item that is permanently attached to the leading end of the carrier sheet and forms a component of the packaging web assembly that is merely snapped into the second storage section of cover section 18 when a new packaging web is loaded into place.

Before the carrier sheet 26 reaches the take-up reel 60, it passes under an upper pressure roller 64 rotatably mounted in cover section 18 between take-up reel 60 and the end of spring platen 58 so as to rotate about an axle shaft 66. As will become apparent later, when cover section 18 is closed, roller 64 is positioned over another pressure-applying roller 68 mounted in base section 16 so as to rotate about shaft 70. As part of the processing operation, the film unit to be processed and an overlying liquid-soaked pad 24 on carrier sheet 26 will be advanced between the pressure-applying rollers 64 and 68 for applying a compressive force to the sandwich for urging the pad 24 into good liquid-yielding contact with the outer surface of the film unit.

In order to successively open the containers 36 to present a fresh uncovered pad 24 at the processing section overlying the spring platen 58, the carrier sheet take-up reel 60 and the supply reel take-up reel 54 must be driven so they each simultaneously take up the same amount of material. This can be done by providing both the take-up reels with the same diameter hub and simultaneously driving them at the same rate.

Figure 6:
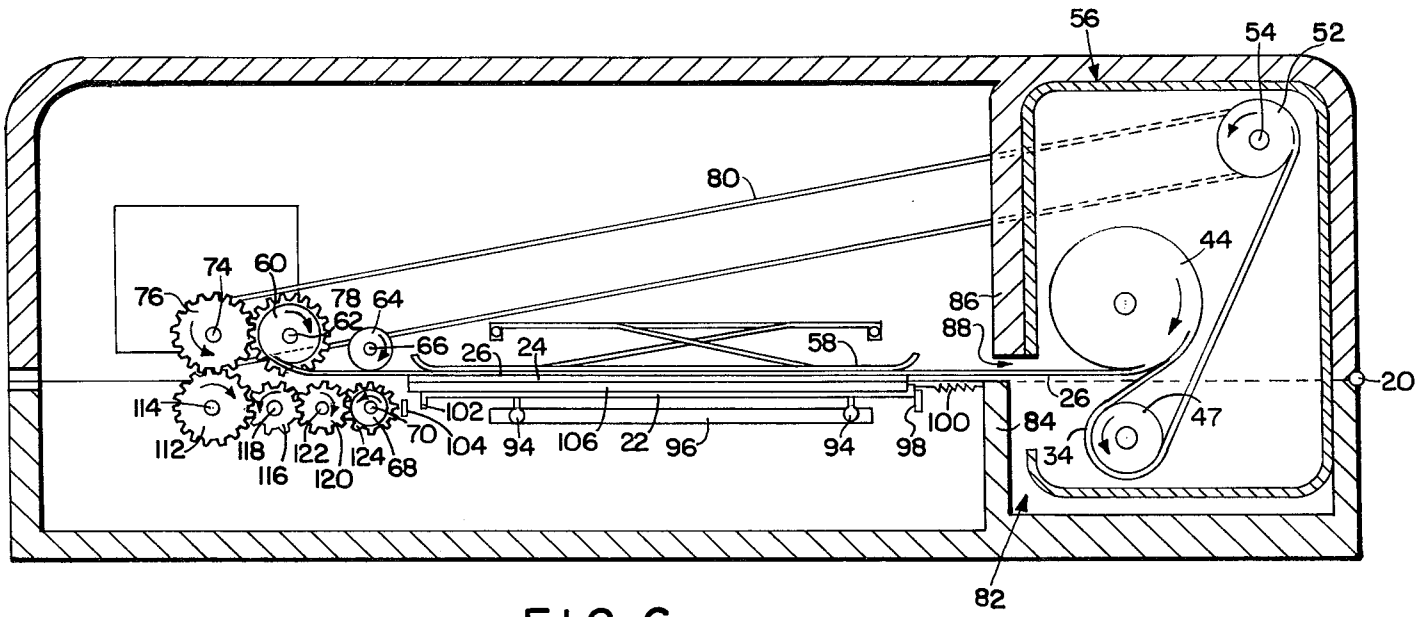
FIG. 6 is similar in some respects to FIG. 5 but shows the cover section in its closed position.

As best shown in FIGS. 5 and 6, apparatus 10 is provided with a drive system which includes a small electrical motor 72 mounted in the leading end of housing section 18. Motor 72 has an output shaft 74 which has a drive gear and pulley assembly 76 secured thereto. The gear portion of drive assembly 76 is in mesh with a complementary gear 78 on the end of carrier sheet take-up reel 60. The pulley section of drive assembly 76 is connected to a complementary pulley section on the end of cover sheet take-up reel 52 by means of a friction drive belt 80 extending therebetween.

As viewed in FIGS. 5 and 6, when motor 72 is energized it rotates in a direction so that shaft 74 drives drive assembly 76 in a counterclockwise direction. Drive assembly 76 in turn through gear 78 drives the carrier sheet take-up reel 60 in a clockwise direction thereby winding the carrier sheet thereon and advancing it from the supply roll 44, through exit opening 48 and across the spring platen in the processing section to the take-up reel 60. Simultaneously, drive assembly 76 through drive belt 80 drives the cover sheet take-up reel 52 in a counterclockwise direction thereby advancing the cover sheet 34 along its divergent path of travel around idler roller 47 and on to the cover sheet take-up reel 52. By advancing the carrier and cover sheets along divergent paths of travel near the bottom of the supply roll 44, a tensile stress is set up in the interface between the carrier and cover sheets thereby providing a force which is sufficient to overcome the holding power of the bond so that the edge seals 38 and transverse seals 40 on the web are progressively pulled apart or released.

Although not shown on the drawing, those skilled in the art will appreciate that predetermined measured amount of web 12 may be advanced during each operating cycle of the motor 72 by providing locating indicia or notches at regular spaced intervals along the web 12 which are sensed by sensor adjacent the web path of travel in cover section 18 and form part of an automatic motor control circuit. That is, the motor may be actuated and it will run until one of the registration marks is encountered by a sensor at which time it will be automatically shut off.

As best shown in FIGS. 1 and 5, the base section 16 includes a recess 82 at the trailing end thereof for receiving the lower portion of container 42 releasably held in chamber 56. As best shown in FIG. 6, when cover section 18 is closed, an upright wall 84 forming part of recess 82 cooperates with a wall 86 in cover section 18, forming part of recess 56, to define a horizontal passageway 88 therebetween which is aligned with the exit path of travel of the carrier sheet 26 through the container exit opening 48.

The previously noted film support platen 22 is mounted in a central portion of base section 16 between recess 82 and the lower pressure-applying roller 68. Film support platen 22 includes an upper horizontal film support surface 90 which is surrounded on three sides by a raised film locating flange 92 (see FIG. 1).

In the illustrated embodiment, platen 22 is mounted for limited fore and aft reciprocating motion by means of two sets of depending casters 94 that are captured in and roll along corresponding guide channels 96 on the opposite side walls 97 of housing section 16. Platen 22 is shown in its normal initial position with the trailing end of flange 92 in abutment with a locating stop 98 on one side wall 97 of housing section 16. Platen 22 is normally urged into abutment with stop 98 by a biasing spring 100 having one end secured to the trailing end of platen 22 in its opposite end secured to wall 84. From the normal position shown in FIGS. 5 and 6, the platen 22 may be moved forwardly toward lower roller 68 until a downturned flange 102 on the leading end of platen 22 abuts against a fixed stop 104.

A sheet-like photosensitive film unit 106 that is to be processed is placed on support surface 90 with the trailing end of the film unit in abutting relation with the trailing end of raised flange 92. In this manner, film unit 106 is located at a predetermined position with respect to housing section 16 and the lower roller 68. It will be noted, that the platen 22 is somewhat shorter than the length of the film unit 106 so that a small leading end portion 108 of the film unit extends forwardly of the platen flange 102. The reason for this configuration will become apparent later when the processing cycle is explained in detail. When so supported on the platen, the upwardly facing outer surface 110 of the film unit is in position to be engaged by an applicator pad 24 located at the processing position on cover section 18.

As noted earlier, film unit 106 is exposed in an imaging apparatus, such as a camera, and is removed therefrom and transferred to apparatus 10 in a photographic darkroom or a suitable actinic light-excluding environment for processing. The film unit 106 may be of the conventional type or it may be a self-processing or self-developing film unit.

For representative examples of different types of film units 106 that may be processed by wetting an outer surface 110 thereof with a low viscosity processing liquid, reference may be had to commonly assigned co-pending application U.S. Ser. No. 436,189 filed on Oct. 22, 1982. This application also provides examples of compatible low viscosity processing liquids that may be yieldably held in the absorbent pad 24.

As best shown in FIG. 6, when the cover section 18 is closed, the applicator pad 24 on the carrier sheet 26 is registered in overlying relation with the outer surface 110 of film unit 106. As will become apparent later, in response to advancing the carrier sheet 26 forwardly by driving take-up reel 60 the carrier sheet 26, the pad 24 thereon and the support platen 22 carrying film unit 106 thereon will move forwardly to insert the leading end of the film unit and pad on the carrier sheet into the bite of the pressure-applying rollers 64 and 68.

In the illustrated embodiment, the lower roller 68 is adapted to be rotatably driven in a counterclockwise direction (as viewed in FIGS. 5 and 6) to advance this laminate therebetween while applying a compressive pressure thereto.

As best shown in FIG. 6, when cover section 18 is closed, the gear portion of drive assembly 76 also becomes enmeshed with a roller drive train gear 112 which is mounted for rotation about shaft 114. Gear 112 in turn is in mesh with the first intermediate gear 116 that rotates about shaft 118. Gear 116 is in turn in mesh with a second intermediate gear 120 which rotates about shaft 122. Gear 120 in turn is in mesh with a gear 124 on the end of the lower roller 68. Thus, when cover section 18 is closed and motor 72 is energized, the gear portion of drive assembly 76 drives both the web sheet take-up spools 60 and 52 and also drives the lower roller 68 through the intermediate gear train.

In use, the operator opens the cover section 18 and loads a packaging web assembly thereinto. The web supply roll container 42 is inserted into a recess 56 where it is releasably held by snap-in type detent (not shown). When so located, a square end of the cover sheet take-up reel shaft 54 is inserted into a conforming keyway on the take-up reel pulley driven by drive belt 80. A carrier sheet leader protruding through exit opening 48 and coiled on a disposable carrier sheet take-up reel 60 is extended across the face of the spring plate 58 in the processing section and the take-up reel 60 is similarly snapped into place in position to be driven by the gear portion of drive assembly 76.

An exposed film unit 106 to be processed is placed on support surface 90 of platen 22 with its outer surface 110 that is to be wetted with the low viscosity processing liquid facing upwardly. With cover section 18 remaining in the raised position, the operator manually presses a cycle start button 126 mounted on a leading end wall 128 of cover section 18. The depression button 126 closes a normally open switch in a motor drive control circuit (not shown) causing the motor 72 to be energized. Through drive assembly 76, the carrier sheet take-up reel 60 and the cover sheet take-up reel 52 are rotatably driven to progressively peel the cover sheet from the carrier sheet and thereby open the first container 36 and simultaneously advance the carrier sheet 26 forwardly. When the previously noted sensors detect a registration mark on carrier sheet 26, the motor is de-energized thereby stoping advancement of both the carrier and cover sheets to locate an uncovered liquid-soaked pad 24 at the processing position in preparation for bringing it into overlying relation to the film unit 106 on support platen 22.

In the illustrated embodiment, the distance between the web supply roll 44 and the carrier sheet take-up reel 60 may be though of as a web segment having a given unit length. The applicator pads 24 and their corresponding enclosures 36 are located on every other web segment along the length of web 12. That is, there is an empty or blank web segment having a given unit length between each container 36. These blank web segments, are of the same given unit length and serve as connecting leaders between successive container 36. In the blank web segments the carrier sheet and cover sheet portions are releasably sealed together without having an applicator pad therebetween.

To process film unit 106, the cover section 18 is pivoted downwardly to the closed position of FIGS. 2 and 6. As best shown in FIG. 6, the liquid-soaked pad 24 is brought into overlying contact with the outer surface 110 of film unit 106. The spring platen 58 is configured such that when cover section 18 is closed, it applies a downwardly directed compression force on the back side of the carrier sheet to urge the pad into frictional engagement with surface 110. During this period, there is an initial wetting of the surface 110 with the liquid held in pad 24. However, to insure that the pad 24 is brought into good liquid-yielding contact with the entire surface 110, it is preferable to advance the superposed pad and film unit between the compressive pressure-applying rollers 64 and 68.

This is accomplished by the operator once again actuating button 126 to energize motor 72 for another drive cycle. As noted earlier, when cover section 18 is closed, the gear portion of drive assembly 76 also engages the roller drive train to rotatably drive the lower roller 68.

During the initial portion of this drive cycle, the carrier sheet 26 is advanced forwardly as it is taken up on take-up reel 60. Because pad 24 is secured to carrier sheet 26, it also advances forwardly therewith. The spring platen 58 applies a sufficient compressive force to the back side of the carrier sheet such that the pad 24 frictionally engages the outer surface 110 of the film unit 106 which is urged toward the support surface 90 with sufficient force so that its bottom side is in frictional engagement with the platen 22. Thus, by frictional coupling, the film unit 106 and movable platen 22 are coupled to pad 24 for forward advancement therewith. As the leading end of the pad 24 and the leading end 108 of the film unit 106, which extends forwardly of the leading end of the platen flange 102, are fed into the bite of the rollers 64 and 68 and are frictionally engaged thereby, the leading end flange 102 of the platen 22 comes into engagement with stop 104 which prevents further forward motion of the spring platen 22. However, by this time the rollers 64 and 68 have the carrier sheetapplicator pad-film unit sandwich in driving engagement. The lower roller 68 is rotated in a counterclockwise direction as viewed in FIG. 6 so that the sandwich is advanced between the rollers which apply a compressive force thereto to establish good liquid-yielding contact between the pad 24 and the film unit surface 110. In response to the pulling force applied by the rollers, the film unit 106 slides forwardly over the stopped platen 22 so that it is advanced between the rollers along with the applicator pad 24 secured to the carrier sheet 26 being wound up onto the take-up reel 60 on the exit side of the top roller 64.

Although not shown in the drawings for the sake of visual clarity, on the exit side of the rollers is a stripper bar, which inserts itself between the pad 24 and film unit surface 110 to separate them, and a horizontal film support and guide plate that defines a horizontal exit path of travel for the film unit 106 leading to an exit opening 130 in the forward end of apparatus housing 14. Thus, on the exit side of the rollers 64 and 68, the carrier sheet 26 having the pad 24 thereon is separated from the film unit and is wound onto the take-up reel 60 which stores that portion of the carrier sheet having expended pads 24 thereon. Film unit 106 is separated from the pad by the stripper bar and is propelled by the rollers along the horizontal guide surface through the exit opening 130 which communicates with the interior of the optional receiving chamber 28. Once the trailing end of the film unit 106 clears the platen, the spring 100 return the platen 22 to its initial position.

At the end of this web-advancement cycle the expended applicator pad 24 has been wound onto the carrier sheet take-up reel 60 and the next segment on the web which is a blank segment extends between the supply roll 44 and the take-up reel 60 across the processing section defined by spring platen 58. Thus, the next pad 24 on the web remains enclosed in its corresponding container 36 on the supply roll 44.

To process the next film unit, the cover section 18 is once again opened. The next film unit is placed on platen 22 and button 126 is actuated to initiate a web-drive cycle to unseal the next container 36 and locate the pad 24 therein at the processing position. The cover section 18 is closed and the motor is once again actuated to repeat the processing operation described above.

Apparatus 10 may be modified in various ways without departing from the inventive concepts embodied therein. For example, the web may be advanced while cover section 18 is in its closed position to locate a fresh pad 24 at the processing position. In this case, the spring platen 58 would be of the retractable type that allows clearance over the film unit 106 on platen 22 so the pad 24 would not engage the outer surface 110 during its transport to the processing position. Once the pad 24 is aligned over the film unit 106, the spring platen 58 would be moved downwardly to move pad 24 into engagement with film surface 110.

In another embodiment, the film support platen 22 could be fixed if a pick mechanism is provided to push the film unit 106 into the bite of the pressure-applying rollers when the carrier sheet 26 is advanced to move pad 24 into engagement with the rollers.

Since certain other changes may be made in the above-described film processing apparatus without departing from the sprit and scope of the invention herein involved, it is intended that all matter contained in the above description or shown in the accompanying drawings shall be interpreted as illustrative and not in a limiting sense.

What is claimed is:

1. A film processing apparatus for use with a liquid applicator packaging web of the type including an elongated flexible carrier sheet, a plurality of liquid applicator pads secured to one side of the carrier sheet in spaced-apart relation along its length and each yieldably holding a supply of a low viscosity processing liquid adapted to be applied to an outer surface of a sheet-like photosensitive film unit to initiate processing thereof, and an elongated flexible cover sheet superposed with the carrier sheet in covering relation to the applicator pads, the carrier and cover sheets being selectively releasably sealed together in facing areas thereof surrounding each of the applicator pads to form a plurality of serially connected containers on the web, each enclosing a corresponding one of the applicator pads therein, said film processing apparatus comprising:

means for supporting such a film unit;

means for supporting such a liquid applicator packaging web;

means for advancing the web relative to said web support means in predetermined increments to separate the cover sheet from the carrier sheet and successively unseal and open each of the containers and locate the corresponding uncovered applicator pad therein at a processing position; and means for bringing an uncovered applicator pad located at said processing position into liquid-yielding contact with the outer surface of the film unit to apply the liquid thereto to initiate processing of the film unit.

2. The film processing apparatus of claim 1 wherein said means for supporting the web includes a first storage section for storing that portion of the web having the releasably sealed containers thereon, and a second storage section for storing that portion of the carrier sheet having expended applicator pads thereon.

3. The film processing apparatus of claim 2 wherein said means for advancing the web includes means for advancing the carrier sheet along a first path of travel from said first storage section to said processing position and then to said second storage section, and means for advancing the cover sheet along a second path of travel within said first storage section for stripping the cover sheet from the carrier sheet and then moving the separated portion of the cover sheet to a storage location.

4. The film processing apparatus of claim 3 wherein said means for advancing the carrier sheet includes a cover sheet take-up reel in said second storage section to which the carrier sheet is attached and means for rotatably driving said carrier sheet take-up reel, and said means for advancing the cover sheet includes a carrier sheet take-up reel to which the carrier sheet is attached and means for rotatably driving said cover sheet take-up reel.

5. The film processing apparatus of claim 3 wherein said first and second paths of travel diverge within said first storage section to effect stripping of the cover sheet from the carrier sheet.

6. The film processing apparatus of claim 1 wherein said means for moving an uncovered applicator pad into liquid-yielding contact with the film unit outer surface includes means for applying a compressive force to the uncovered applicator pad and the film unit to bring them into liquid-yielding contact.

7. The film processing apparatus of claim 6 wherein said compressive force applying means includes a spring platen acting on that portion of the carrier sheet supporting an uncovered applicator pad at the processing position for urging the applicator pad into contact with the outer surface of the film unit.

8. The film processing apparatus of claim 7 wherein said compressive force applying means further includes a pair of pressure-applying rollers between which the uncovered applicator pad on the carrier sheet and film unit are advanced after the applicator pad is urged into contact with the film unit by said spring platen.

9. The film processing apparatus of claim 1 wherein said web supporting means includes a first storage section for storing that portion of the web having the releasably sealed containers thereon, a processing section wherein an uncovered applicator pad supported by the carrier sheet is adapted to be located in preparation for moving it into liquid-yielding contact with the outer surface of the film unit supported by said film supporting means, and a second storage section for storing that portion of the carrier sheet having expended applicator pads thereon.

10. The film processing apparatus of claim 1 wherein said web advancing means includes means for advancing the carrier and cover sheets along different paths of travel to effect the stripping of the cover sheet from the carrier sheet.

11. The film processing apparatus of claim 1 further including a housing having a base section mounting said film unit supporting means and a cover section, mounting said web supporting means, said cover section being coupled to said base section for movement relative thereto between an open position and a closed position

12. The film processing apparatus of claim 1 including means for storing that portion of the cover sheet that has been separated from the carrier sheet.

13. The film processing apparatus of claim 1 including means for storing that portion of the carrier sheet having expended applicator pads thereon

14. A film processing apparatus for use with a liquid applicator packaging web of the type including an elongated flexible carrier sheet, a plurality of liquid applicator pads secured to one side of the carrier sheet in spaced-apart relation along its length and each yieldably holding a supply of a low viscosity processing liquid adapted to be applied to an outer surface of a sheet-like photosensitive film unit to initiate processing thereof, and an elongated flexible cover sheet superposed with the carrier sheet in covering relating to the applicator pads, the carrier and cover sheets being selectively releasably sealed together in facing areas thereof surrounding each of the applicator pads to form a plurality of serially connected containers on the web, each enclosing a corresponding one of the applicator pads, said film processing apparatus comprising:

a housing having a base section and cover section coupled to said base section for movement relative thereto between an open position and a closed position;

means in said base section for supporting such a film unit;

means in said cover section for supporting such a liquid applicator packaging web, said web supporting means including a first storage section for storing that portion of the web having the releasably sealed containers thereon, a processing section wherein an uncovered applicator pad supported by the carrier sheet is adapted to be located in preparation for bringing the pad into liquid-yielding contact with the outer surface of a film unit supported by said film supporting means, and a second storage section for storing that portion of the carrier sheet having expended applicator pads thereon;

means for advancing the carrier and cover sheets relative to said web supporting means along different paths of travel in predetermined increments to separate the cover sheet from the carrier sheet and successively unseal and open each of the containers and locate the uncovered applicator pad therein at said processing section; and means for bringing an uncovered applicator pad located at said processing section into liquid-yielding contact with the outer surface of the film unit to apply the liquid thereto to initiate processing of the film unit.

15. The film processing apparatus of claim 14 wherein said means for advancing the carrier and cover sheets includes a cover sheet take-up reel to which the cover sheet is attached, a carrier sheet take-up reel to which the carrier sheet is attached, and means operable for rotatably driving said cover and carrier sheet take-up reels.

16. The film processing apparatus of claim 15 wherein said cover sheet take-up reel is located in said first storage section and receives and stores that portion of the cover sheet that has been separated from the carrier sheet.

17. The film processing apparatus of claim 15 wherein said carrier sheet take-up reel is located in said second storage section and stores that portion of the carrier sheet having expended applicator pads thereon.

18. The film processing apparatus of claim 14 wherein said means for bringing the uncovered applicator pad into contact with the film unit includes means for applying a compressive force to the applicator pad and film unit.

* * * * *